United States Patent [19]

Gallagher, Jr.

[11] 4,416,610

[45] * Nov. 22, 1983

[54] WATER-IN-OIL EMULSIFIER AND OIL-BURNER BOILER SYSTEM INCORPORATING SUCH EMULSIFIER

[75] Inventor: John P. Gallagher, Jr., Pennsauken, N.J.

[73] Assignee: Hydroil, Inc., New York, N.Y.

[ * ] Notice: The portion of the term of this patent subsequent to Aug. 17, 1999 has been disclaimed.

[21] Appl. No.: 348,592

[22] Filed: Feb. 12, 1982

Related U.S. Application Data

[63] Continuation of Ser. No. 130,513, Mar. 14, 1980, Pat. No. 4,344,752.

[51] Int. Cl.[3] ..... F23D 13/14

[52] U.S. Cl. ..... 431/4; 431/354; 366/150; 366/167; 252/359 A; 137/888; 137/889

[58] Field of Search ..... 110/238; 431/2, 4, 354; 44/51; 252/359 A, 359 D; 366/150, 167, 183, 176, 336; 137/888, 892, 893, 896, 897

[56] References Cited

U.S. PATENT DOCUMENTS

| | | | |
|---|---|---|---|
| 1,626,487 | 4/1927 | Warren | 252/359 D |
| 2,705,620 | 4/1955 | Borck | 366/167 |
| 3,183,864 | 5/1965 | Stengel | 431/4 |
| 3,601,318 | 8/1971 | Gehring et al. | 137/893 |
| 3,876,363 | 4/1975 | La Haye et al. | 431/210 |
| 4,116,610 | 9/1978 | Berthiaume | 44/51 |
| 4,123,800 | 10/1978 | Mazzei | 366/150 |
| 4,344,752 | 8/1982 | Gallagher | 431/354 |

*Primary Examiner*—Carroll B. Dority, Jr.

*Attorney, Agent, or Firm*—Frishauf, Holtz, Goodman and Woodward

[57] ABSTRACT

An oil-water emulsifier comprises a Venturi member having an inlet for receiving oil, an oil-water emulsion outlet and an opening extending therethrough from the inlet to the outlet. The opening of the Venturi member comprises a diameter-reducing portion which connects to a throat portion having a substantially smaller diameter than the inlet, the throat portion being connected to an expanding portion extending from the throat to the outlet, the diameter of the outlet of the opening being substantially greater than that of the throat portion. A plurality of water injection holes extend from the outer periphery of the Venturi member to the throat portion so as to be in communication with the oil flowing through the throat portion, the injection holes being preferably substantially perpendicular to the direction of oil flow through the throat portion. Also disclosed is an oil-burner boiler system incorporating the above-described oil-water emulsifier.

19 Claims, 17 Drawing Figures

FIG. 4a
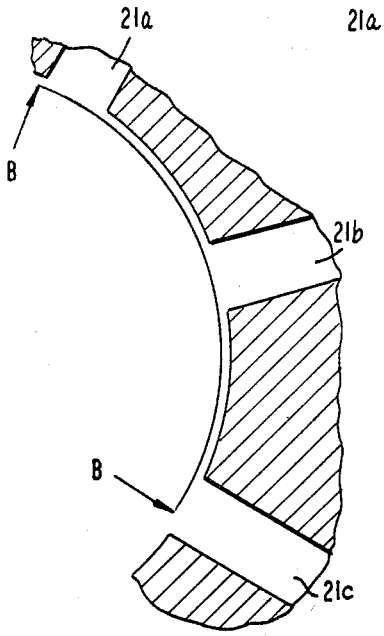
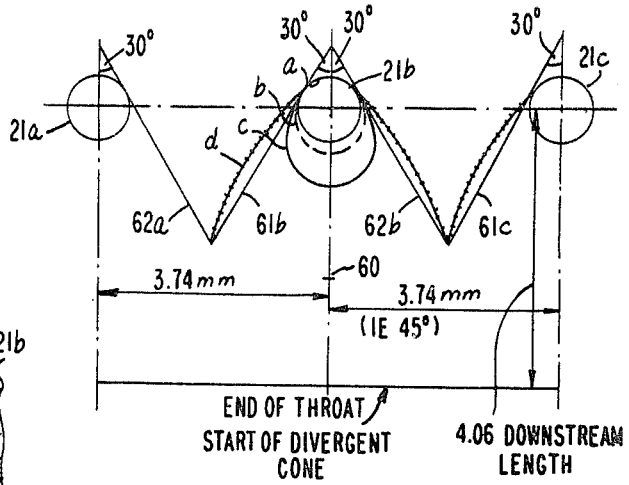
FIG. 4b
FIG. 14
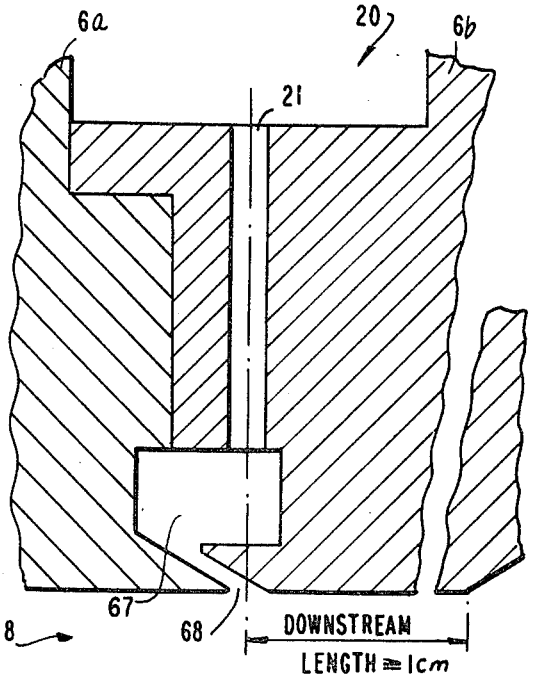

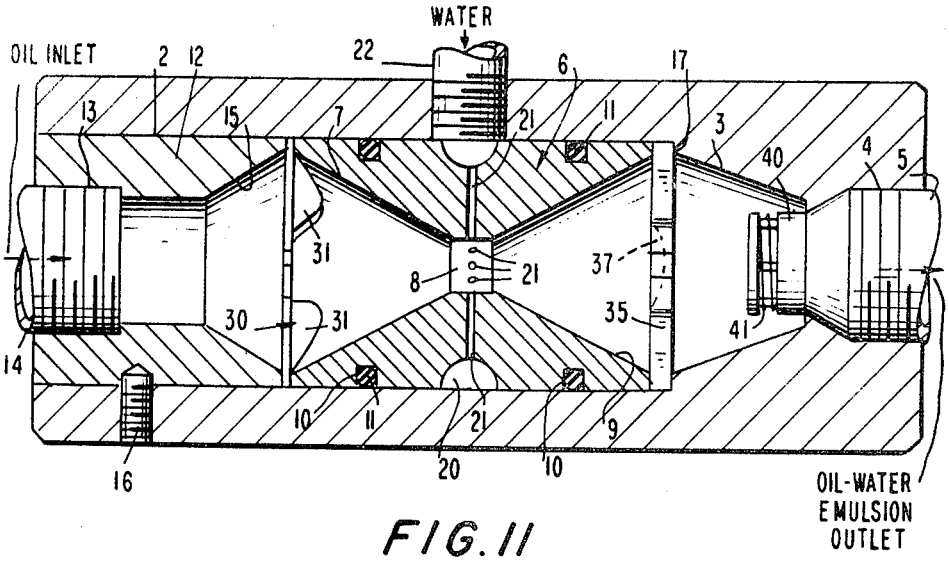
FIG. 11
FIG. 12a
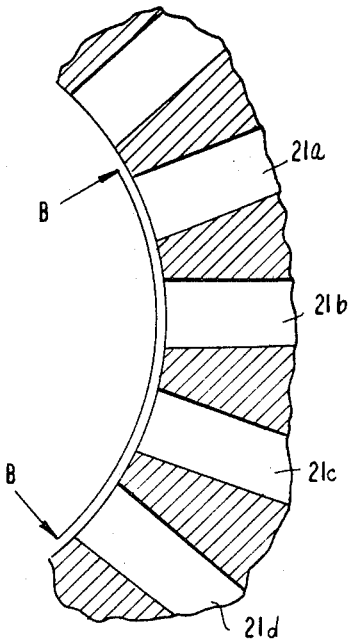
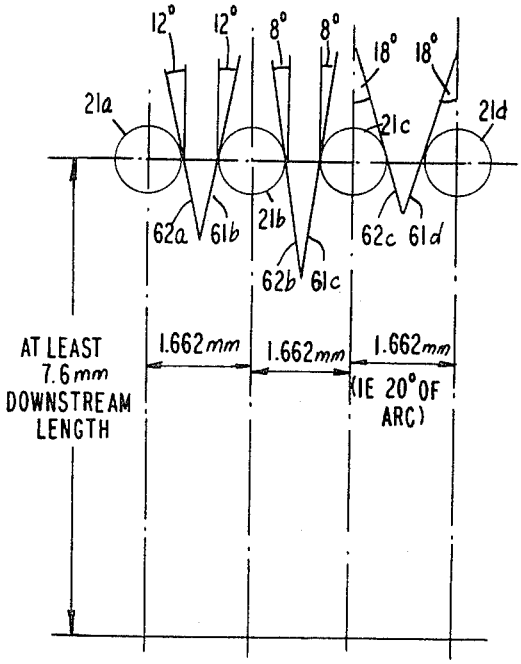
FIG. 12b

WATER-IN-OIL EMULSIFIER AND OIL-BURNER BOILER SYSTEM INCORPORATING SUCH EMULSIFIER

This is a continuation of application Ser. No. 130,513 filed Mar. 14, 1980, now U.S. Pat. No. 4,344,752.

BACKGROUND OF THE INVENTION

This invention relates to water-in-oil emulsifiers, and more particularly, to a water-in-oil emulsifier particularly suitable for use with fuel oil and for emulsifying water into the fuel oil to form a combustible new mixture.

In the past, efforts have been made to mix water into fuel oil to provide a combustible mixture which is fed, for example to an oil burner of a boiler. The prior devices are either too complicated, too expensive or do not provide suitable combustible mixtures in a reliable manner.

The main object of the present invention is to provide a water-into oil emulsifier which has no moving parts, is simple and inexpensive to manufacture and maintain, and which yet provides excellent emulsification characteristics.

A further object of the invention is to provide an emulsifier which provides smaller, and especially more uniform, water droplet sizes, so that when the water-oil emulsion is atomized into small globules-in-air, these globules will more uniformly explode when heated. One advantage of providing small, uniform water droplets to each oil globule is that a secondary atomization in combustion will result, which can be responsible in part for a large reduction in soot production by the oil burner arrangement, Greatly reduced sooting rate greatly reduces mean fire-to-water heat transfer losses, if the intervals between de-sooting shutdowns are kept constant. Such reduced losses result in savings of fuel, which not only help meet the nation's energy-saving goals, but also directly and visibly repay the heating-system owner with substantially reduced annual fuel costs. In most cases, longer intervals between de-sooting are also possible, while still keeping the mean soot-caused heat transfer losses negligible. This may be an important factor in operations where a two-day shutdown is necessary for de-sooting, especially if this interferes with production. Also, since soot production is reduced, it may be possible to use a cheaper grade oil and still maintain environmental standards for particulate emissions from furnace combustion.

Uniformity of water droplet diameters makes it feasible to have three or more water droplets inside the smallest oil globules (to provide the explosive secondary atomization to every such globule) while minimizing excess water—which is useless—and unnecessarily reduces the temperature of the fire.

SUMMARY OF THE INVENTION

In accordance with the present invention, an oil-water emulsifier comprises a so-called Venturi member having an inlet for receiving oil, an oil-water emulsion outlet, and an opening extending therethrough from said inlet to said outlet. The opening of the Venturi member comprises an abrupt or gradual diameter-reducing portion (in the preferred embodiment, the diameter decreases gradually in the form of a straight conical taper), and this diameter reducing portion connects to a throat portion having a substantially smaller diameter than said inlet, said throat portion then connecting to an expanding portion having a gradually increasing diameter (preferably in the form of an outward taper) extending from the throat portion to the outlet, the diameter of the outlet of the opening being substantially greater than that of the throat portion. A plurality of water injection holes extend from the outer periphery of the Venturi member to the throat portion so as to be in communication with the oil flowing through the throat portion, the injection holes being substantially perpendicular to the direction of flow of oil through the throat portion.

Preferably, an expansion chamber is provided in communication with the inlet end of the body member, through which incoming oil flows. Further, in a preferred arrangement, a constricting chamber is provided in communication with the outlet end of the central member through which the oil-water emulsion flows. A back-pressure-maintaining valve (like the usual ball check valve, but with a heavier spring) is preferably provided at the outlet end of the device, preferably at the outlet of the constricting chamber.

In a still further preferred arrangement, a baffle plate is provided at the inlet of the body member for producing swirl of the incoming oil flow, and a further baffle plate is provided at the outlet of the body member against which the outward flowing emulsion impinges.

BRIEF DESCRIPTION OF THE DRAWINGS

FIG. 4*a* is a greatly enlarged end-view of a fragment of said central insert, sectioned in the plane of the center-lines of its water-injection holes;

FIG. 4B is a developed view of the inside cylindric arcuate surface B—B of FIG. 4A, with possible water-oil boundaries useful in explaining one possible mode of action of my emulsifier;

FIG. 11 illustrates a modification of the embodiment of FIG. 1;

FIG. 12*a* is a greatly enlarged end-view of a fragment of a modified central insert sectioned in the plane of the center-lines of its water-injection holes (similar to FIG. 4*a* but having 18 holes 20° apart);

FIG. 12*b* is a developed view of the inside cylindric arcuate surface B—B of FIG. 12*a;*

FIG. 14 is an axially-sectioned view of a fragment of the throat-wall of a modified central insert which may prove superior to the preferred embodiment.

DETAILED DESCRIPTION

Figure 1:
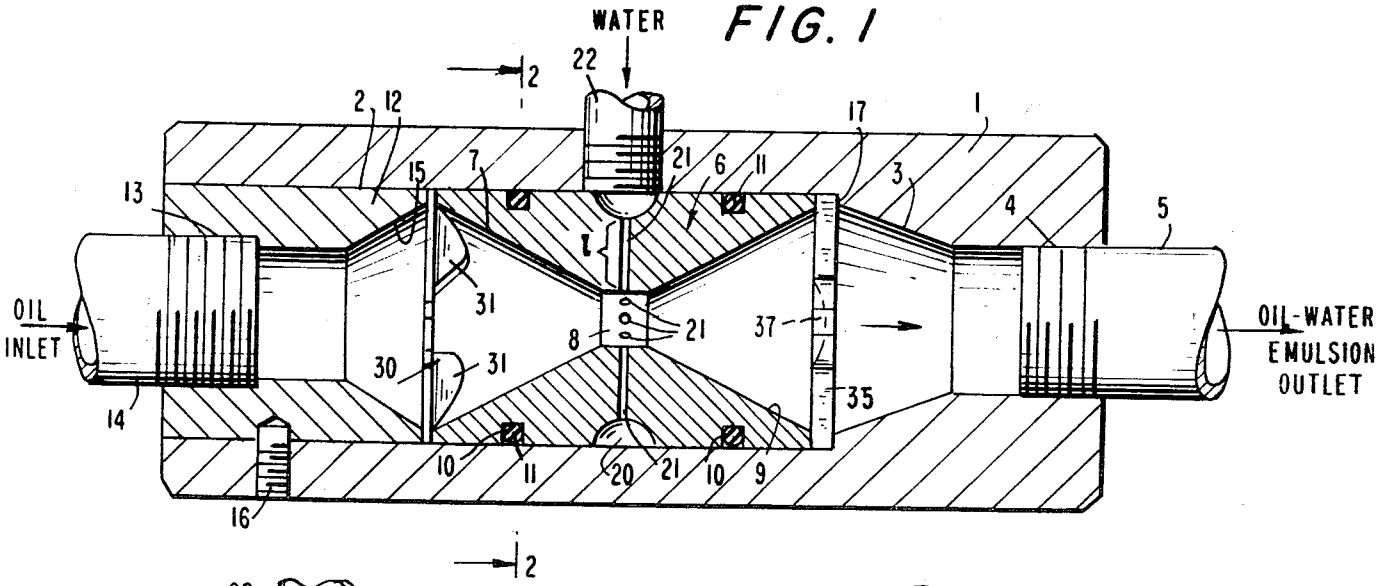
FIG. 1 is a longitudinal cross-sectional view of an embodiment of the present invention.
Figure 3:
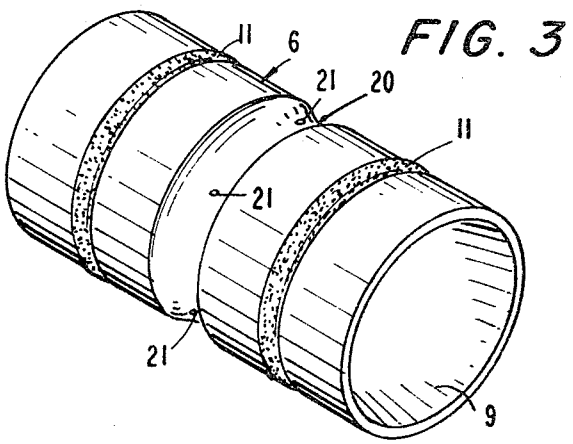
FIG. 3 is a perspective view of the central insert incorporating a Venturi opening.
Figure 2:
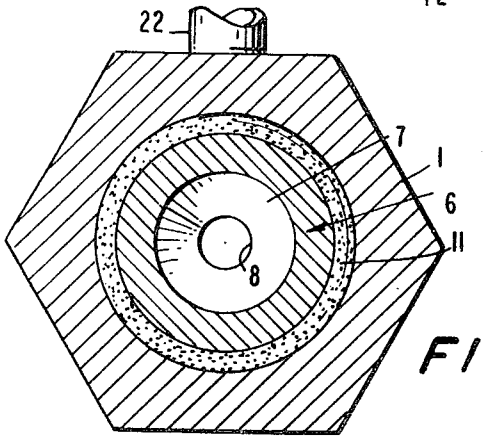
FIG. 2 is a cross-sectional view thereof taken along the line 2—2 in FIG. 1.

An oil-water emulsifier of the present invention shown in FIGS. 1-9 comprises a housing 1 having a longitudinal bore therein for receiving the emulsifier apparatus. The longitudinal bore comprises a generally cylindrical portion 2, a conically tapered portion 3 leading from the cylindrical bore 2 to an exit bore portion 4. The exit bore portion 4 is internally threaded to receive an exit connecting pipe or other coupler 5.

Received in cylindrical bore 2 is a central insert 6 (63.5 mm long) having a Venturi-shaped opening therethrough. The opening through the insert 6 comprises a downwardly tapered portion 7 [length 27.69 mm, initial ID38.35 mm, tapering at 27.5° (half-cone angle) to final ID of 9.525 mm] which extends from the inlet portion of insert 6 toward the central portion thereof, a cylindrical throat 8 (of 9.525 mm diameter and 8.12 mm length) and an outwardly flared or tapered portion 9 (identical to portion 7 but reversed) which extends from the throat 8 to the outlet end of the insert 6. The insert 6 comprises external channels 10 for receiving O-rings 11 which provide a fluid-tight seal between insert 6 and the internal surface bore 2.

An end insert 12 is provided at the inlet end of central insert 6 and has an internally threaded end portion 13 for receiving an inlet oil coupling 14. Preferably, the inlet insert 12 has an outwardly flared portion 15 which leads to the inlet end of central insert 6. As illustrated in FIG. 1, the maximum diameter of the outwardly flared portion 15 is substantially the same as the maximum diameter portion of the tapered portion 7 of the central insert 6. A set screw 16, or the like, is provided through the housing 1 and end insert 12 to lock the end insert 12 and central insert 6 in the bore 2. The housing 1 has an abutment 17 for retaining the central insert 6 at the exit side of the cylindrical bore 2.

The central insert 6 has a substantially central outer peripheral groove 20 formed therein. The groove 20, which extends circumferentially around the insert 6, is, in the illustrated embodiment, generally semicircular in shape. Other shapes could be used. A plurality of bores 21 are formed in the central portion of the insert 6 which extend from the circumferential groove 20 to the throat area 8 of the insert 6. A conduit 22 is coupled to the housing 1 in communication with the circumferential groove 20 for supplying water to the circumferential groove 20, the water in turn being fed through the bores 21 to the throat area 8 of the central insert. Oil is supplied through oil inlet 14, the oil and water forming an emulsion in the area of the throat 8 in a manner only partially understood by me, as discussed hereafter in connection with FIGS. 13, 14, **4*a*, 4*b***.

Figure 6:
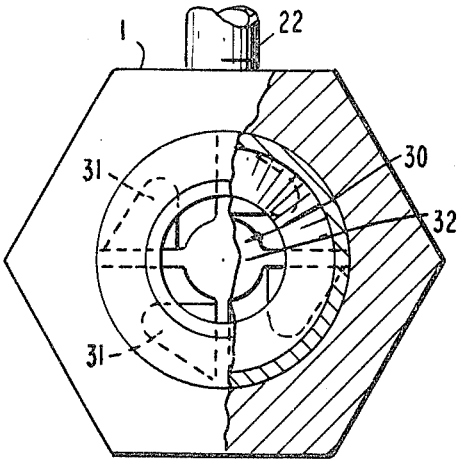
FIG. 6 is a part sectional end view of the emulsifier of the present invention in its assembled state, as viewed from the left side in FIG. 1.
Figure 8:
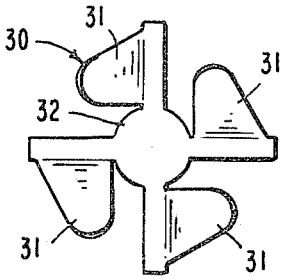
FIG. 8 is a plan view of the deflector and rotation imparting element at the entrance side of the emulsifier as viewed in FIG. 1.

In order to improve performance, a propeller-like swirl-inducing deflector baffle 30 is provided at the inlet end of the central insert 6. The baffle 30 is seen in FIGS. 1, 6 and 8. The baffle 30 is impinged upon by the oil flowing through the oil inlet 14, the baffle 30 having wings 31 which are inwardly bent in the direction of flow of the oil, as best seen in FIG. 1. The baffle 30 is also provided with a disc-like central portion 32 which slows the flow in the center of the oil stream.

The result of the use of the baffle 30 is that the central part of the stream is slowed down and a swirl imparted to the outer part of the oil stream. As the diameter of the oil stream decreases (because of the taper of portion 7), the rotation rate increases, since the angular momentum tends to remain constant. This improves the emulsification effect occurring in the vicinity of the throat 8, since the water droplets (which are denser than the oil matrix in which they are dispersed) are mostly kept near the walls where the laminar shear rate is maximum.

Figure 7:
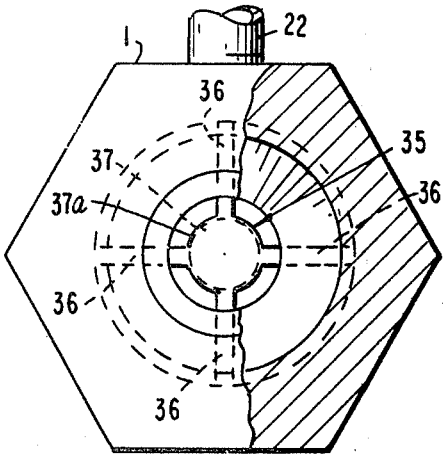
FIG. 7 is a part sectional end view of the emulsifier in its assembled state, as viewed from the right side in FIG. 1.
Figure 9:
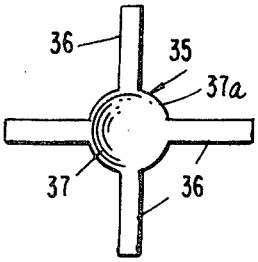
FIG. 9 is a plan view of the deflector at the exit side of the emulsifier as viewed in FIG. 1.

An exit baffle element 35, as best seen in FIGS. 7 and 9, is provided at the outlet end of central insert 6. As seen in FIG. 1, the exit baffle 35 has legs 36 which extend from a central disc-like concavely-machined portion 37 (with sharp edges **37*a*), the legs being rectangular in cross-section, with sharp corners, and being located between the abutment 17 and the end of central insert 6 (FIG. 1) to retain the exit baffle 35 in position. The oil-water emulsion flowing out of the central insert 6 impringes on the exit baffle 35**, and where it strikes the sharp edges or corners, some splitting of oversize water droplets is achieved to further improve the emulsion.

Figure 10:
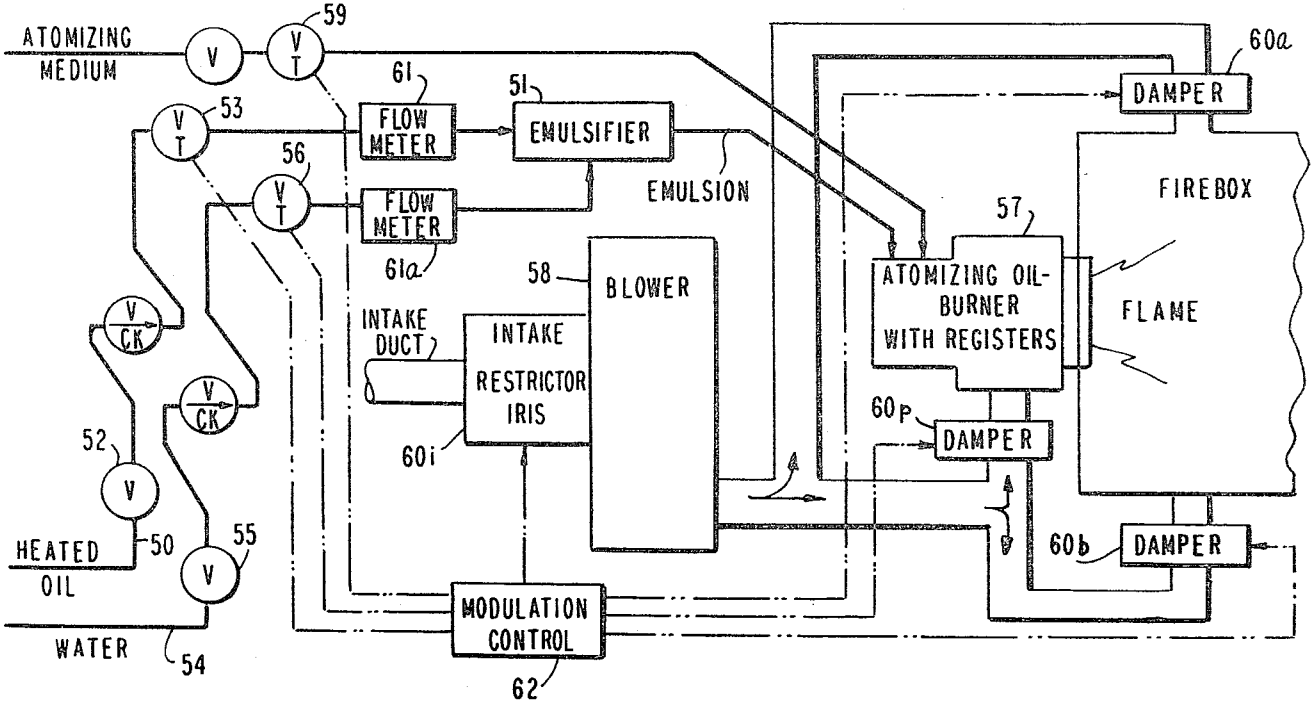
FIG. 10 schematically illustrates an oil burner system incorporating the present invention.

FIG. 10 symbolically illustrates an oil-burner boiler system using the emulsifier device discussed hereinabove. An oil supply line 50 is coupled (preferably through a check valve) to the oil inlet 14 of the emulsifier 51 (the emulsifier 51 preferably being as illustrated in FIG. 1) via a shut-off valve 52. A gangably-actuatable flow regulator 53 may be connected to the oil line, preferably downstream of the valve 52. A water line 54 is connected to the water inlet 22 of emulsifier 51 preferably via a check valve and a shut-off valve 55. A gangably-actuatable flow regulator 56 may be coupled to the water line to vary the flow therethrough preferably downstream of the valve 55. The water-in-oil emulsion produced by the emulsifier is fed directly to an oil burner 57. The gaseous atomizing medium (compressed air or steam) and the primary air branch of the output from main blower 58, after passing through gangably actuatable flow regulators 59, **60*p* are fed to the oil burner 57, as is conventional, and the oil burner produces a flame as symbolically indicated in FIG. 10. Flow meters 61, 61*a* may be provided to monitor the flow of the water and/or oil, and/or the emulsion produced by the emulsifier 51**.

The modulation control arrangement 62, which may comprise an arrangement of ganged cams, or linkages and cams, is arranged to modulate (i.e. turn-down or turn-up) all the essential firing-rate-controlling flows together. These include (1) primary airflow; (2) one, two, or several secondary air-flows—if separately varied as they usually are; (2a) (in the more efficient medium-sized installations) control of input air flow into blower; (3) oil flow; (4) flow of water to be admixed with the oil; and (5) flow of the gaseous atomization fluid (compressed air and/or steam). Although the control arrangement must turn down all five flows simultaneously, it is not satisfactory to turn them down in the same proportion.

Probably the most vital ratio is the oil/(total air) ratio, but even this ratio is usually set so as to vary slightly over the modulation range for minimizing sooting during and after cold starts, while maximizing efficiency at the highest much-used firing rate. For least total annual cost the (secondary air)/total air) ratio is usually set to vary over the modulating range, and similarly it will often be desirable to slightly vary the water-/oil ratio as the firing rate is modulated.

In FIG. 10, the gangably-actuatable flow-regulating devices are 53 for oil) 56 for water, 59 for atomizing medium, and (for "wind control"—i.e. control of the low pressure air flows) 60*p* for primary air, 60*a*, 60*b*, etc., for secondary air, and 60*i* for restricting input flow into blower 58. The reference numbers 60 with alphabetic subscripts related to wind-impeding regulators for very low pressure air (called "dampers", "registers", "input-restricting vanes" or "irises", etc.). But reference numbers 53, 56, 59 are valve-like flow regulators (usually called throttling or metering valves). Applicant prefers to use North American and Cash metering valves from North American Manufacturing Company and Cash Manufacturing Company. These values are adapted to be conveniently swung through small, medium, or large angular arcs (by the usual adjustable lever arms and links). Then, after the arc-swung through, and the two end positions of the valve (at full firing rate and minimum firing rate) have been set to give roughly the desired flows of oil, water and atomizing fluid, any desired fine tuning is conveniently done by an adjustable cam built into each valve, with 8 . . . 12 adjusting screws to adjust the flow rate given by the cam at 8 . . . 12 cam positions.

In the (symbolically illustrated) oil-burner boiler system of FIG. 10 using the previously described emulsifier, it is preferred that the oil and water pressure be initially adjusted to be roughly the same at the oil and water inlets, respectively. The unit is dimensioned such that a small amount of water, 5 to 12% of total volume, for example, is finely dispersed into the fuel oil. The resulting microscopic water droplets (which tests have shown to range from 2 to 5 microns or even 1 to 2 microns in diameter) are produced by turbulence around baffle 35 and by the inherent mixing effect of the plumbing connecting the emulsifier to the burner. If this plumbing is too short (or its flow too laminar) a 10"–30" length of nominal "half-inch pipe," whose ID=0.493" (12.5 mm) with staggered transverse half-disk baffles welded inside, to compel 10 to 20 sharp zig-zags in the flow, should provide enough turbulence to fully shuffle the peripheral and central portions of the oil stream. When the water-in-oil emulsion exiting the device is atomized (by steam or compressed air) in the burner 57, it forms small (but not microscopic) globules-in-air, each such globule of emulsion containing three or more water droplets. When these small globules are blown into the red-hot fire box, the radiant heat penetrates such globule to quickly superheat the micro water droplets within it; these then turn instantly to steam, exploding the globule. Such mini explosions are now generally accepted by the scientific community as resulting in much finer atomization than is normally achieved by burner atomizers, as well as in more intimate mixing of air and fuel, which in turn improves combustion. The resulting emulsion obtained behaves like a new fuel. Its combustion is widely different from that of fuel oil alone, and in many respects, has been found to approximate that of natural gas. The resulting emulsion is combusted with a marked reduction in soot generation and unburned particulates. This allows complete combustion with less excess air and higher combustion efficiency. The reduction of soot results in less contamination of the boiler heat transfer surfaces and, therefore, a more efficient system. These results mean that in a practical sense, the boiler furnace, which ordinarily becomes less efficient with use, operates over extended periods of time closer to design efficiency. This effect has been confirmed by test results.

The cleaner burning provided by the oil-fuel emulsion which results from the use of the device of the present invention offers advantages which result in economic benefit to the user. Through the secondary atomization (occurring in mini-explosion fashion upon entering the fire box) the fuel is so dispersed that it acts almost like a gas and combustion is quick and nearly complete with very little creation of carbon particulates. As a result, the deposit of soot on the heat exchange surfaces is minimized. This not only provides improved long-term efficiency, but also minimizes the amount of down time required for cleaning. Due to improved atomization, excess air can be reduced and combustion efficiency is increased. This increase in efficiency more than compensates for the heat required to vaporize the added water. The reduction of flame temperature at the burner and the reduction of excess air combine to lower production of $SO_3$ and $NO_x$, thereby reducing corrosion and improving equipment life. The emulsion generated by the device of the present invention can be combusted in conventional atomizing burners.

A further advantage of the present invention is that the device is very compact and can be located very close to the oil burning device. Therefore, the path from the emulsifier to the oil burning device is very short and the emulsion remains stable during its transfer from the emulsifier to the oil burning device, even at low firing rates. Also if some of the water droplets agglomerate during an overnight shutdown, only a small amount of fuel is thus impaired in effectiveness.

As illustrated, the water injection opening 21 are at right angles to the direction of oil flow through the throat 8. The water injection openings are also in the high velocity portion of the Venturi (i.e. in its throat 8). This construction results in a highly efficient emulsification with extremely small and extraordinarily uniform water droplet diameters (especially if oil flow rate and kinematic viscosity of the heated oil are chosen to give a Reynolds number far below 1200, even under Hi-flo conditions (as defined shortly hereafter, in the paragraph introducing "TABLE 1 and TABLE 2"). Preferably, the inlet pressure of the water is roughly the same as the inlet pressure of the fuel oil, each being preferably about 20 psi, but must be adjusted to give the desired oil and water flow rates, so that the final adjusted pressure may differ by 10% or 20% in some cases. In a preferred arrangement, eight water injection openings 21 (of 1.092 mm dia. and 1.2 cm length) are provided which are distributed around the circumference of the central insert 6, preferably 45° apart. If desired, pressure regulators can be provided at the water and/or inlet openings.

The preferred embodiment of the present invention as shown in FIGS. 1–9 has been tested by Adelphi Center for Energy Studies (at Adelphi University, Garden City, New York) under the following conditions. A low-sulfur, moderately light-weight #6 oil was heated during the test, to 60° C. (140° F.). The viscosity at 60° C. was tested and found to be 55 centistokes (i.e., its kinematic viscosity was 0.55 stokes). Both the water and oil pressure were roughly 20 psi during the tests. Oil flow was adjusted to 150 gallons per hour (i.e. 2.5 gallons per minute) as determined by weighing the oil delivered in a measured time interval before the water injection was started (i.e. with only oil being pumped).

The pumps are a kind of screw-type pump whose flow rate, once set, varies only slightly when back pressure varies. Thus the flow, initially found to be close to 150 g.p.h. (i.e., about $2\frac{1}{2}$ gallons per minute), would not have varied more than 1 or 2% when the water flow was started. Then water flow was begun and set to a 0.25 gal/minute flow rate (presumably by a calibrated flow meter). Thus, water-flow was very close to 10% of oil flow. No other water/oil rates were tested. No other flow rates were tested. In the emulsifier under test, the throat diameter (portion 8 in FIG. 1) was 0.375 inches (9.525 mm). Eight water injection holes 21 were provided, each having diameter of 0.043 inches (1.092 mm). The length of each water injection opening 21 was 0.4725 inches (1.200 cm). Under the above conditions, excellent emulsion characteristics were obtained as follows. With an oil flow rate of about 2.5 gallons per minute, and a 10% water/oil ratio, photomicrographs of the resulting emulsion showed that more than 95% of the water droplets were in the range of 2–5 μm in diameter. This was seen and photographed through a special microscope, using an oil-immersed objective lens of 400 diameters magnification. Another emulsion specimen photographed with an oil-immersed lens of 1000 diameters magnification showed nearly all of its water droplets to be in the 1 . . . 2 μm range.

Table 1 and Table 2 list water and oil velocities and Reynolds members calculated for the preferred embodiment of my invention (shown in FIGS. 1–9 and described—with most important dimensions given—in conjunction with such figures. (This preferred embodiment is also identified to the model actually tested as discussed just above). But the calculations of Table 1 and 2 cover four sets of recommended operating conditions as follows: "Hi-flow conditions"=2.5 US gallons 1 minute (157.5 $cm^3/s$) with two typical water/oil ratios of 0.10 and 0.07 (corresponding to water/emulsion ratios of 9.1% and 6.5%). "Lo-flo conditions"=1.666 US gallons/minute (105 $cm^3/s$) with two typical water/oil ratios of 0.10 and 0.07 (water/emulsion ratios of 9.1% and 6.5%) (only one of these four-sets of conditions was used in the above discussed test: High-flow with 0.10 water/oil ratio).

If a boiler or heating system has a maximum rated firing rate at a maximum permissible firing rate, and if such maximum firing rate is actually used for a substantilly part of the total operating time in practical operation. "Hi-flo" conditions are to be understood to mean the oil-flow for such maximum firing rate. But, if the highest firing rate frequently used in practical operations is well below the maximum-permissible or maximum-rated firing rate, "High-flo conditions" should be understood to refer to the highest level firing rate used often enough and long enough so that the fuel burned at and above said level amounts to 20% (or more) of its total annual fuel consumption.

TABLE 1

Velocity Symbols, Meanings, Values Used in Studying Operation of Preferred Model

| Symbol | Meaning | | Values Used in Studies of Preferred Embodiment |
|---|---|---|---|
| $v_{\phi 2}$ | Oil velocity at ℄ of throat (Lo-flo condition: $Q_{02}$ = 105 $cm^3/s$) | | 294.7 cm/s |
| $v_{\phi 3}$ | Oil velocity at ℄ of throat (Hi-flo condition: $Q_{03}$ = 157.5 $cm^3/s$) | | 442.1 cm/s |
| $v_{r2}$ | Oil velocity at radius r (Lo-flo condition: $Q_{02}$) | | 0 at r = .47625 cm* (i.e. at wall) |
| $v_{r3}$ | Oil velocity at radius r (Hi-flo condition: $Q_{03}$) | | 0 at r – .47625 cm* (i.e. at wall) |
| $\overline{V}_{02}$ | Mean oil velocity in throat $\left(\text{Lo-flo condition: } Q_{02} = 105 \frac{cm^3}{s}\right)$ | = | $147.4 \frac{cm}{s}$ |
| $\overline{V}_{03}$ | Mean oil velocity in throat Hi-flo condition: $Q_{03} = 157.5 \frac{cm^3}{s}$ | = | $221.0 \frac{cm}{s}$ |
| $\overline{V}_{72}$ | Mean water velocity in each water injection hole $Q_w = .07 \times Q_{02}$ $\left(\text{Lo-flo condition: } Q_{02} = 105 \frac{cm^3}{s}\right)$ | = | $98.1 \frac{cm}{s}$ |
| $\overline{V}_{73}$ | Mean water velocity inj.-hole $Q_w = .07 \times Q_{03}$ $\left(\text{Hi-flo condition: } Q_{03} = 157.5 \frac{cm^3}{s}\right)$ | = | $147.1 \frac{cm}{s}$ |
| $\overline{V}_{102}$ | Mean water velocity in inj.-hole $Q_w = .10 \times Q_{02}$ | = | $140.1 \frac{cm}{s}$ |

TABLE 1-continued

| Symbol | Velocity Symbols, Meanings, Values Used in Studying Operation of Preferred Model: Meaning | | Values Used in Studies of Preferred Embodiment |
|---|---|---|---|
| | $\left(\text{Lo-flo condition: } Q_{02} = 105 \frac{cm^3}{s}\right)$ | | |
| $\overline{V}_{103}$ | Mean water velocity in inj.-hole | = | $210.1 \frac{cm}{s}$ |
| | $Q_w = .10 \times Q_{03} = 157.5 \frac{cm^3}{s}$ | | |
| $\overline{V}_0$ & $\overline{V}_w$ | denote mean oil-flow and mean water-flow velocities generally where it is not intended to relate to specific Lo-flo or Hi-flo conditions; nor to specific .07 or .10 water/oil ratios | | |
| V | denotes velocity of a water droplet in oil (or a sphere or spheroid modeling such droplet | | |

*for smaller radii, see Eqs. 1A, 1Aδ, 2A, 2Aδ and Tables 1A, 2A

TABLE 2

| | Other Symbols, Meanings, Values Used in Studying Operation of Preferred Model | | |
|---|---|---|---|
| D | Diam. of oil-flow throat | = | .9525 cm |
| d | Diam. of each water-injection hole | = | .10922 cm |
| $D_d$ | Viscous drag (or sphere or spheroid) in dynes | | |
| F | Initial rate-of-fractional velocity loss | = | Dd/MV |
| M | Mass in grams | | |
| m | Absolute viscosity (at relevant temp.) in poises relevant temp. may be shown (in diag. C) by a subscript | | |
| N | Reciprocal of e-folding time (usually a large negative number denoting a very rapid exponential decay) | | |
| n | No. of water-injection holes (in model studied) (we believe 16–36 probably would be better) | = | 8 |
| l | Length of each water-injection hole | = | 1.200 cm |
| $L_D$ | Downstream length (from hole ℄'s to end of throat) | = | .406 cm |
| P | An integer, (positive or negative) power of 10 | | |
| $Q_0$ & $Q_w$ | denote oil-flow rates and water-flow rates generally, in $cm^3/s$ (also called ml/s) | | |
| $Q_{02}$ | denotes oil-flow rate in Lo-flo conditions | = | $105 \frac{cm^3}{s}$ |
| $Q_{03}$ | denotes oil-flow rate in Hi-flo conditions | = | $157.5 \frac{cm^3}{s}$ |
| $Q_{72}$ | denotes water-flow in Lo-flo conditions with water-flow = .07 × oil-flow = .07 × 105 | = | $7.35 \frac{cm^3}{s}$ |
| $Q_{73}$ | denotes water-flow in Hi-flo conditions with water-flow = .07 × oil-flow = .07 × 157.5 | = | $11.025 \frac{cm^3}{s}$ |
| $Q_{102}$ | denotes water-flow in Lo-flo conditions with water-flow = .10 × oil-flow = .10 × 105 | = | $10.5 \frac{cm^3}{s}$ |
| $Q_{103}$ | denotes water-flow in Hi-flo conditions with water-flow = .10 × oil-flow = .10 × 157.5 | = | $15.75 \frac{cm^3}{s}$ |
| $Re_{02}$ | denotes Reynold's No. (of oil in throat in Lo-flo conditions) for light #6 oil at 60° C., $Re_{02} = \overline{V}_{02} \times D/V60^* \cong 255$ or less | | |
| $Re_{03}$ | denotes Reynold's No. (of oil in throat in Hi-flo conditions) for light #6 at 60° C., $Re_{03} \approx F_{03} \times D/V60^* \cong 383$ or less | | |
| $Re_{72} \ldots Re_{103}$ | for water, may use same subscripts as $\overline{V}_{72} \ldots \overline{V}_{103}$ (see Table 1) | | |
| δ = | Difference between radius r (to a chosen point near throat's way) and max-possible-radius, D/2. δ is thus the distance from chosen point to wall. | | |
| μ | used as prefix, denotes $1/10^6$X; but standing alone it means "micron" - now renamed micrometer (μm), but still widely used by scientists under old name. 1μ (is 1 micron) = 1 μm = 0.0001 cm | | |
| $V_{38}$ or $V_{60}$ = | kinematic viscosity (in stokes) at 38° or 60° C. (i.e. 100° or 140° F.) | | |

TABLE 2-continued

| Other Symbols, Meanings, Values Used in Studying Operation of Preferred Model | |
|---|---|
| Vsus38 or Vsus60 = | kinematic viscosity (in Saybolt Univ. Seconds) at 38° or 60° C. (i.e. 100° or 140° F.) |
| P | denotes density in gms/cm$^3$ |

*Light #6 oil conventionally used at 60° C. (thicker grades used at higher temps. up to about 82° C.)

Equations 1A, 1Aδ, 1B, 2A, 2Aδ, 2B, given below, are for calculating $V_{r2}$, $V_{r3}$, and their shear rates for Hi-Flow and Lo-flow conditions (at various distances from wall of throat 8) under pure laminar flow.

Table 1A and Table 2A (below) give 15 instructive already calculated values of $V_{r2}$, $V_{r3}$ and their shear rates for 15 selected values of radius r (i.e. for 15 selected distances δ from the wall). Since these are calculated by Equations 1A, 1AS, 1B, 2A, 2AS, 2B they will be found just after these equations.

In a modified embodiment, as shown in FIG. 11, the exit end of the housing 1 is provided with a back-pressure-maintaining valve 40, like a ball type check valve, but with its spring 41 stiff enough in relation to the area of its opening so as to maintain a few psi of back-pressure (even when this back pressure might otherwise fall almost to zero).

Applicant believes that an important consideration in the present invention is that the sum of areas of all of the water injection channels should be about 0.075 to 0.30 times the area of the Venturi throat.

Equations 1A, 1Aδ, 1B, 2A, 2Aδ, 2 B (for compacting $V_{r2}$, $V_{r3}$, and their shear-rates)

Equations 1A, 2A, (standard parabolic equations for figuring $V_{r2}$, $V_{r3}$ from given values of r)

Equations 1Aδ, 2Aδ [same equations rearranged to use given values of $$\left(\text{i.e. of } \frac{D}{2} - r\right)$$

instead of values of r]

Equations 1B, 2B for figuring rates-of-change of $V_{r2}$, $V_{r3}$ with respect to changes in r (these rates-of-change are called the "shear-rates" of the fluid at the points when they are computed)

$$V_{r2} = 294.7 - 1299r^2 \text{—precise unless too near wall} \quad (1A)$$

$$\left[\text{i.e. unless } \frac{P}{2} - r < .16 \text{ cm}\right]$$

$$V_{r2} = 1299\,[.9525\delta - \delta^2] \text{ where} \quad (1A\delta)$$

$$\delta \text{ is } \left(\frac{D}{2} - r\right) \text{—good precision for any value of } \delta$$

$$d(V_{r2})/dr = 2598R \text{—this is the "shear rate" of } V_{r2} \quad (1B)$$

$$V_{r3} = 442.1 - 1949\,r^2 \text{—precise unless too near wall} \quad (2A)$$

$$\left[\text{i.e. unless } \frac{D}{2} - r < .05 \text{ cm}\right]$$

$$V_{r3} = 1949\,(.9525\delta - \delta^2) \text{ when} \quad (2A\delta)$$

-continued $$\delta \text{ is } \left(\frac{D}{2} - r\right) \text{—good precision for any value of } \delta$$

$$d(V_{r3})/dr = 3898r \text{—this is the "shear rate" of } V_{r3} \quad (2B)$$

TABLE 1A (Velocities and shear rates at 15 selected radii) for "Lo-Flo" Condition (105 ml/s of oil) through .9525 cm throat per Eq. 1A, 1Aδ, 1B

| Distance from wall = δ | Radius = r = .47625 − δ | Velocity $V_{r2}$ Table 1 & Eqs. 1A, 1Aδ | d($V_{r2}$)/dr = Shear rate Eq. 1B |
|---|---|---|---|
| 0 cm | .47625 cm | 0 cm/s | 1237 cm/s/cm |
| .0001 cm = 1μ | .47615 cm | .1237 cm/s | 1237 cm/s/cm |
| .001 cm = 10μ | .47525 cm | 1.236 cm/s | 1235 cm/s/cm |
| .01 cm = 100μ | .46625 cm | 12.23 cm/s | 1211 cm/s/cm |
| .02 cm = 200μ | .45625 cm | 24.23 cm/s | 1185 cm/s/cm |
| .03 cm = 300μ | .44625 cm | 35.95 cm/s | 1159 cm/s/cm |
| .04 cm = 400μ | .43625 cm | 47.41 cm/s | 1133 cm/s/cm |
| .08 cm = 800μ | .39625 cm | 90.67 cm/s | 1029 cm/s/cm |
| .16 cm = 1600μ | .31625 cm | 164.7 cm/s | 821.6 cm/s/cm |
| .31625 cm | r = .160 cm | 261.4 cm/s | 415.7 cm/s/cm |
| .39625 cm | r = .080 cm | 286.3 cm/s | 207.8 cm/s/cm |
| .41625 cm | r = .060 cm | 290.0 cm/s | 155.9 cm/s/cm |
| .43625 cm | r = .040 cm | 294.0 cm/s | 103.9 cm/s/cm |
| .45625 cm | r = .020 cm | 294.2 cm/s | 51.96 cm/s/cm |
| .47625 cm | r = 0 (on ) | 294.7 cm/s | 0 cm/s/cm |

TABLE 2A (Velocities and shear rates at 15 selected radii) for "Hi-Flo" conditions (157.5 ml/s of oil) through .9525 cm throat per Eq. 2A, 2Aδ, 2B

| Distance from wall = δ | Radius = r = .47625 − δ | Velocity $V_{r3}$ Table 1 & Eqs. 2A, 2Aδ | d($V_{r3}$)/dr = Shear rate Eq. 2B |
|---|---|---|---|
| 0 cm | .47625 cm | 0 cm/s | 1856 cm/s/cm |

TABLE 2A-continued (Velocities and shear rates at 15 selected radii) for "Hi-Flo" conditions (157.5 ml/s of oil) through .9525 cm throat per Eq. 2A, 2Aδ, 2B

| Distance from wall = δ | Radius = r = .47625 − δ | Velocity $V_{r3}$ Table 1 & Eqs. 2A, 2Aδ | $d(V_{r3})/dr$ = Shear rate Eq. 2B |
|---|---|---|---|
| .0001 cm = 1μ | .47615 cm | .1862 $\frac{cm}{s}$ | 1856 $\frac{cm/s}{cm}$ |
| .001 cm = 10μ | .47525 | 1.854 $\frac{cm}{s}$ | 1853 $\frac{cm/s}{cm}$ |
| .01 cm = 100μ | .46625 | 18.37 $\frac{cm}{s}$ | 1817 $\frac{cm/s}{cm}$ |
| .02 cm = 200μ | .45625 | 36.35 $\frac{cm}{s}$ | 1778 $\frac{cm/s}{cm}$ |
| .03 cm = 300μ | .44625 | 53.95 $\frac{cm}{s}$ | 1739 $\frac{cm/s}{cm}$ |
| .04 cm = 400μ | .43625 | 71.14 $\frac{cm}{s}$ | 1701 $\frac{cm/s}{cm}$ |
| .08 cm = 800μ | .39625 | 136.0 $\frac{cm}{s}$ | 1544 $\frac{cm/s}{cm}$ |
| .16 cm = 1600μ | .31625 | 248.2 $\frac{cm}{s}$ | 1232 $\frac{cm/s}{cm}$ |
| .31625 cm | r = .160 cm | 392.2 $\frac{cm}{s}$ | 623.7 $\frac{cm/s}{cm}$ |
| .39625 cm | r = .080 cm | 429.6 $\frac{cm}{s}$ | 311.8 $\frac{cm/s}{cm}$ |
| .41625 cm | r = .060 | 435.1 $\frac{cm}{s}$ | 233.9 $\frac{cm/s}{cm}$ |
| .43625 cm | r = .040 | 439.0 $\frac{cm}{s}$ | 155.9 $\frac{cm/s}{cm}$ |
| .45625 cm | r = .020 | 441.3 $\frac{cm}{s}$ | 77.9 $\frac{cm/s}{cm}$ |
| .47625 cm | r = 0 (on ) | 442.1 $\frac{cm}{s}$ | 0 $\frac{cm/s}{cm}$ |

Preferably, the sum of the areas of all of the water injection channels should be between about 0.10 and 0.24 times the area of the Venturi throat if the water/oil ratio to be used is between 0.7 and 0.10. Moreover, the mean oil velocity in the throat of the Venturi should be greater than or comparable with the mean velocity of the injected water, preferably between 1.05 and 1.65 times the mean water velocity.

It has been found that even at full firing rate of the furnace (FIG. 10) the Reynold's number Re of the oil flow in the Venturi throat should be far below 1200, and preferably well under 600. The Reynold's number of the oil flow in the Venturi throat is determined by the following equation:

$$Re = [(V_0 \text{ in cm/sec}) \times (\text{throat diameter in cm})] \div (\text{kinematic viscosity of oil in stokes at temperature at which oil is emulsified})$$

With the above Reynold's number limitation, laminar flow, rather than turbulent oil flow at the throat, is insured, so that water droplets will be more uniform in size with very few water droplets greater than 10 to 15 microns in diameter. Heretofore, turbulent flow has been aimed at in an attempt to more finely break up the water streams into drops. Applicant believes that he is the first to learn and teach that laminar flow of the oil in the throat of the Venturi is better. The reasons for this are not well understood. Perhaps one reason is that turbulence is a statistical process governed by chance. It is probably better to have all droplets below 10 mm even if very few are below 4 μm at the cost of accepting 5% above 25 μm. Once the largest water globules are less than 10 microns in diameter, further comminution is believed to provide no substantial additional value to the operation of a medium-large system. One disadvantage of turbulent oil flow is that the flow can, sometimes, for an instant, have zero or very low velocity at the wall where the water stream enters the Venturi. Thus, a small percentage of water droplets may be much larger than the mean size. Assume a hypothetical case where 99% of all droplets were exactly 3 μm in diameter with only 1% of them being 25 μm in diameter. These rare 25 μm droplets would have an aggregate volume more than 5 times as great as the aggregate volume of all the very numerous smaller ones. Therefore 5/6 of all the water would be almost useless water which takes up a great deal of heat, without exploding very many emulsion globules. Applicant believes that it is better to have the water droplets more uniform in size while still being fine enough to provide an effective result. This is contrary to the prior art object of having very fine water droplets (finer than needed and at accepting the fact that about one to three percent of these droplets will be several times larger because of instantaneous zero or near zero flow velocities at one or another of the water injection points. As mentioned above, these larger droplets have a relatively large aggregate volume and explode a negligibly small % of the emulsive globules. Applicant is not bound by the theoretical explanation given above, but only by the limitations in the system set forth in the claims. As used in the present specification and in the claims, the term "multiplicity of water streams" means at least four such streams, and preferably 6 to 24 of such streams.

The term laminar flow (according to pages 3–49, lines 17–18 of Baumeister's Standard Handbook) means that its velocities are free of macroscopic fluctuation, the flow being called turbulent if the velocities have macroscopic fluctuation. But as used herein "laminar flow" or flow referred to as "100% laminar macroscopically" should be understood to means that the flow is substantially free from tubulence characterized by eddies, except for micro-turbulence in the vicinity of the water-injection holes (having only eddies comparable with or smaller than 0.5d), and except for water-body-induced turbulence in the vicinity of sheared-off (or wall-hugging) blobs or puddles or streams of water such water-induced turbulence having only eddies comparable with or smaller than the maximum cross-flow dimensions of the inducing water bodies. As used in the above sentence, and in other parts of the text and claims the phase "comparable with" should be understood to means that the sizes or velocities considered comparable are equal within ±15%.

The Baumeister Handbook mentioned just above (and also in one earlier place and another place hereafter) is the "Standard Handbook for Mechanical Engineers" by Baumeister and Marks, 7th Edition, McGraw-Hill, 1951.

In the present invention it has been found that in addition to keeping the Reynold's number for the oil much less than 1200, the mean velocity of each injected water stream should be comparable with or lower than the oil's. mean velocity in the throat under all working conditions. It is also believed to be desirable, while maintaining a 100% laminar cylindrical oil flow (with a parabolic velocity profile as described in Baumeister's Handbook in last five lines of P 3–58 and first two lines of next page) to simultaneously provide a smooth rotational component of motion, so that the total motion is a helical laminer motion with a parabolic velocity profile. This will produce a "centrifuge" action which causes the water droplets to drift outwardly (since water is denser than oil) or at least to slow their inward drift, whereby the larger droplets remain longer in the lower velocity shear rate regions within about 0.25D from the throat's surface, and preferably within 0.18D from such surface.

Although the exact manner in which my emulsifier's central insert 6 acts to break up the water into incredibly fine particles is not yet fully understood by me, I am beginning to believe the comminution does not occur wholly at the mouth of each injection-hole, but must take place at least partly (and perhaps largely) elsewhere; and to believe that the very high shear-rate which results from laminar flow is one of the major factors in "grinding up" the initially-large blobs (or puddles or streams) of water into very fine droplets. But, wherever it takes place, I am convinced that the action certainly includes very fast-moving microscopic interactions mostly between the shear-resisting forces of viscosity and the constant-tension-spring-like forces of surface tensions. I suppose however that momentum-changing (ie mass-accelerating) forces must be considered too.

I would at first have judged, that the injected water streams or big water fragments would be moving sufficiently rapidly ($V_{103}=210$ cm/s—see Table 1) and have enough momentum to rupture the weak surface tensions and coast right through to the center line of the throat, and than past it to the far wall (if they don't collide with other streams or big fragments). But the more I pondered and discussed this the more certain I felt, that this could not have happened when the Adelphi research PhD's obtained (and photographed) their amazingly good emulsion with my emulsifier which had been sent to them for testing.

Tables 1A and 2A show that near the throat's centerline the shear rates are very low. Table 2A (directly applicable to the Adelphi tests since Adelphi's 2.5 gallon/minute oil flow equals Table 2A's 157.5 $cm^3/s$) shows that at $r=0.160$ cm, the shear rate is less than one third as high as the shear rate adjacent the throat's wall; and inside of this radius the shear rates are even lower. This means that there is a comparatively dead "central stream-tube", 0.32 cm in diameter (over $\frac{1}{3}$ of the throat's full diameter) which could be a low-shear resting place for "giant" water droplets—say 0.02–0.08 cm (200 μm to 800 μm) in equivalent diameter which would then end-up, unsplit, in the delivered emulsion.

Surely out of all the swarm of injected big drops (mostly injected at 200–220 cm/sec speed and all aimed at the low-shear central stream-tube) one could expect 25–60% to reach this stream-tube before thay are split into acceptably-fine droplets. Perhaps 6–15% may reach this stream-tube having never been split at all, or having been split just once into a few pieces, so that they still are giants. Any such giants coasting across the stream-tube—whether somewhat slowed, or still at full 200–220, or even 240 cm/s speed,—in fact any giant drops coasting across this tube, will (in the time it takes for a 240 cm/s drop to cross the tube's 0.32 cm width) be carried more than 0.56 cm down-stream by the 423 cm/s average velocity in the tube. Such a 0.56 cm down-stream carry takes the drop far past the 0.406 cm downstream length of the throat so it appears in the emulsion as a giant.

Only two explanations of why no giants appeared in the Adelphi tests occur to me (1) the water-grinding process may be so effective and rapid that all drops are split into droplets less than 10–15 μm in diameter before reaching the tube; (2) something else prevents any drops from reaching the tube, ever.

A recent calculation by one of our corporation's consultants has convinced me (though not really proven) that the second exploration is true: no large or small droplet can coast as far inward as the $r=0.160$ cm boundary.

This calculation concentrated on a droplet equivalent (in volume) to a solid sphere of 0.0427 cm diameter but with a lower-drag shape (a prolate ellipsoid like a tiny football). Such streamlined giant droplet was assumed launched at velocity $V_{103}$(210.1 cm/s) with assumed oil velocity of zero: assumed water flow, $Q_{103}$ (same as in Adelphi test): assumed surface tension of zero, so no energy or momentum lost by droplet in breaking away from water stream; ellipsoid's long axis aligned with its motion, and assumed to re-align itself if perturbations occur.

Equations 3, 4, 5, 5.4 for drag $D_d$, in dynes, on spheres and ellipsoids moving through viscous liquid (e.g. oil) where V = velocitiy through oil in cm/s a = radius of sphere or semi-major-axis of prolate ellipsoid, in cm (football-shaped, with major axis aligned with motion through oil)

m = absolute viscosity of oil, in poises

P = density of oil, in $gm/cm^3$—if equation applies to fluid spheres or ellipsoids m = absolute viscosity of such fluid b = c = radii of the two equal semi-minor-axes of ellipsoid c/a to be $\geqq 0.6$ (Eq 3) Stokes' law for solid sphere—$D_d=6\pi$ ma V (accurate if $Re=2AV\delta/m<1$)

(Eq 4) Babister's modification of Stokes' law to apply to fluid droplets—liquid or gaseous—$D_d=6\pi$ ma $V\times(2m+3m')/(3m+3m')$—probably good over same range of $R_e$ as Equation 3)

(Eq 5) Lamb's law for solid prolate ellipsoids—$D_d=6\pi$ ma $V\div\{1=0.8(1-c/a)\}$ Probably usable with fair accuracy for $Re\geqq 8$ (if Re computed for ball whose radius a > means radius-of-curvature averaged over the end 20% portions of prolate ellipsoid)

(Eq 5.4) Lamb's law for fluid prolate ellipsoid would use Babister modifications (but applied to Lamb's law instead of Stokes' law)—Probably usable with fair accuracy for some range of Re values as Eq 5) if it is valid at all. Note when droplets are accelerating or slowing drag is apparently changed by an amount which can be described in terms of a "carried mass" varying from one-half to twice the mass of the displaced fluid.

Algorithm and Equations 8, 9, 10 to compute slowdown and ultimate distance traveled by spheres or ellipsoids whose drag is linearly proportional to velocity). After computing drag, in dynes, $D_d$, for a chosen velocity V in cm/s, compute mass M of sphere or ellipsoid in grams. $D_d/(MV)\equiv F$ Choose integer P so that $100{,}000F \times 10^P$ is between 1 and 20. Check this by actually doing this calculation.

(Eq 8) $10^{-P} \times \text{Log}_e\{1-(10^P F)\} = N$; if N will be rounded off, do this before computing V/N.

$$y = \frac{V}{N}\left\{1 - \exp(Nt)\right. \quad \begin{matrix}\text{at } t = o,\ y = o \\ \text{as } t - \infty,\ y \to V/N\end{matrix} \qquad \text{(Eq 9)}$$

$$y = V\left\{\exp(Nt)\right. \quad \begin{matrix}\text{at } t = o,\ y = V \\ \text{as } T - \infty,\ y \to o\end{matrix} \qquad \text{(Eq 10)}$$

Note if $D_d$, M, V have been computed to 6 signifying Figure (and F is rounded to best 5 signifying value) and if your calculator accepts and displays 10 significant Figures $100{,}000\ F \times 10^P$ may be between 1&2.

Equation 5 was tried first, because its prolate ellipsoid was judged to have less drag than a sphere; ellipsoid was proportioned with a long axis just 5/3 of minor axes, so skin area was only 10% greater than that of equivalent sphere, while cutting frontal area to 71% of sphere's frontal area; plus the advantage of having long gently curving taper preceding rear tip and very much sharper rear-tip radius-of-curvature. (Eq 5) gave a drag $D_d$ of 93.6 dynes for the above described $0.06 \times 0.036 \times 0.036$ cm ellipsoid as follows:

$$D_d = 6\pi\ (.52\text{ poise})\ (.06\text{ cm})\left(210.1\ \frac{\text{cm}}{\text{s}}\right) \Big/ \left\{1 + .8\left(1 - \frac{.036}{.060}\right)\right\} = 93.6\text{ dynes.}$$

The ellipsoids volume $= (\pi/6)(0.06)(0.036)^2 = 40.7 \times 10^{-6}\text{cm}^3$. Since it is intended to simulate a droplet its mass = volume $\times$ 0.998 (for water at 60° C.) $= 40.6 \times 10^{-6}$ grams. Furthermore, since this droplet will be decelerating, its mass will be effectively increased by a "carried mass" somewhere between ½ and 2 times the mass of the oil displaced by the drop. (See note under Eq 5.4) In view of streamlined shape, carried mass was taken as just half the mass of the displaced oil, increasing mass by only 47% to $59.7 \times 10^{-6}$ gm.

$$F = \frac{D_d}{MV} = 7462.3;$$

$$\underline{\text{Plaken} = -8?}\ (100{,}000\ F \times 10^{-8} = 7.5;\ \text{So OK})$$

$$N = 10^{+8}\ \text{Log}_e\{1 - (F \times 10^{-8})\} = 10^8\ \text{Log}_e(.99992538) = -7462.27$$

Now round off $N$ to 4 Signet Figures; $N = -7462$; $\frac{V}{N} = .0282$

The exponential equation for y is then written per Eq 9) as follows: $y = 0.0282\ \{1\text{-exp}(-7462t)\}$ where t is time in seconds. Note that as $t \to \infty$, y approaches 0.0282 (but theoretically never reaches it). This limit is the "ultimate distance travelled" in the y direction, ie from the water injection hole toward the center line. This would mean that the farthest a 40.6 gram rigid prolate ellipsoid (with the density of water at 60° C., but solid) could coast toward the center line would carry it only 0.282 mm from the wall (less than half the tiny football's own length. But Lamb's equation, on which this calculation was based, is not actually valid for a liquid droplet.

Therefore our consultant tried lifting the Babister modification out of Stoke's original law for solid spheres, and "instead inserting it into Lamb's formula for solid prolate ellipsoids to make this apply to liquid prolate ellipsoids." Viscosity m for oil was 0.52 poises as before; but m′ for water at 60° C. was here needed. This was 0.00469 poises. (Putting the Babister modification into Lambs law may be invalid because stagnation pressure on its nose might very well flatten a liquid football shape into a pumpkin shape, but perhaps the natural pressures might give it a tear-drop shape even better than the football shape).

Equation 5.4 showed a 33% smaller drag of 62.7 dynes as follows, $$D_d = 6\pi\ (.52)(.06)(210.1)\left\{\frac{2(.52) + 3(.00469)}{3(.52 + .00469)}\right\} \div \left\{1 + .8\left(1 - \frac{.036}{.060}\right)\right\} = 62.7\text{ dynes.}$$

As before, the droplet's volume (of water) plus 50% of that volume (of oil) for carried mass, gave $M = 59.7 \times 10^{-6}$ gm. But now $$F = \frac{D_d}{MV} = 4998.8;\ P = -8?\ (100{,}000\ F \times 10^{-8} = 5.0);$$

Say $F = 4999$; Thus $(10^8)$ times
$\text{Log}_e\{1 - (10^{-8}F)\} = N = -4999$; and
$y = .0420\ \{1 - \exp(-4999t)\}$ so that, as $t \to \infty$, $y \to .0420$.

This ultimate travel distance is about 1.5 times as large as with Equation 5, but still is less than the length of the tiny football.

Stoke's law for spheres (Eq 3) and Babister's modification (Eq 4), were considered for the equivalent sphere of 0.0427 cm diameter, but their external Reynold's number (at the injection speed of 210 cm/s and kinematic viscosity of 0.55 stokes) was 32(>>1). A 30-times-smaller sphere gave a Reynold's number of 1.08, and (Eq 3) and (Eq 4) gave drags of 2.9 and 2.0 dynes, but the mass was 27000× less than the mass of the football above discussed, so its "ultimate distance coasted" would be practically zero.

Equations 3, 4, 5, (and data re "carried mass" and external Reynolds numbers for such equations) were taken from "Encyclopaedic Dictionary of Physics" by J. Thewlis; Pergaman Press; New York 1962 pp 648–9 of Vol 7: "Stellar Magnitude" to "Zwitter Ion" and p 318 of vol 6: "Radiation, Continuous" to "Stellar Luminosity".

Maybe if we had used an aerodynamicist as consultant, better equations (really applicable to fast water droplets coasting in oil) might have been found, to give rigorous and conclusive proof that the injected droplets can't coast even ½ mm away from the wall, but the computations above outlined were enough to convince me that they can't coast anywhere near the low-shear stream-tube.

It then occurred to me that for the very tiny motions involved in emulsification, all actions must occur in very short times. If we could magnify everything 50 to 100 times in size and record it on video tape, we probably would have to slow it down 100 times or more to make it seem even faintly realistic and understandable. Several successive greatly enlarged sketches were made to help me visualize the inflowing water being sheared-off in moderately small fragments of 30 μm to 80 μm equivalent diameter (ie diameter if they were spherical).

At first I assumed that the fragments would probably be sheared off against the down stream corner of each injection-hole by the pull of the viscous flowing oil, and sketches were made of a water-oil miniscus protruding only 75 to 100 μm from a hole, by pouring out a flat, fan-like stream of 100μ×100μ×50μ disklets from its down stream edge, (eg from an arc of about 120°) with the disklets quite close together at first, but separating a little more as the flat stream diverged. But the oil velocities within 50 μm or less from the wall, with the parabolic velocity profile (which all authorities agree is the one existing in a mooth or rough pipe at Ro>1200 are so very low that a single layer of disklets as close together as could be reasonalby assumed, wouldn't carry away more than ½% to 1% of the water which actually would be injected from each hole. Attempts to sketch plausible versions with higher protrusion of the water meniscus (and with fragments being delivered not only from the down stream corner of the hole but also from the upper domed surface (assumed to be corrugated with traveling waves from the oil's flow over it) seemed less plausible and still did not account for more than 2% of the water.

Another very greatly enlarged sketch showed an imaginable, but not too probable, build up of a huge bulbous drop, pressed against the wall just down stream from the hole by some sort of side pressure from the oil (here flowing much faster since the drop protruded upward almost to the 800μ lamina). Finally the greater drop surface area and the higher oil velocities encountered as the drop grows in height, exceed the surface tension forces. A ripple along the drops top surface triggers the rupture, and a fat-disk-like drop sails down stream at about the 1000μ level, already elongated and flattened and becoming rapidly more so. This sketch could for the first time account for the release of the amount of water known to flow out of each hole. But, though possible, it did not impress me as most likely to be the true explanation of the water injection action, and it is therefore not here preented as one of the figures of the present application.

Figure 13:
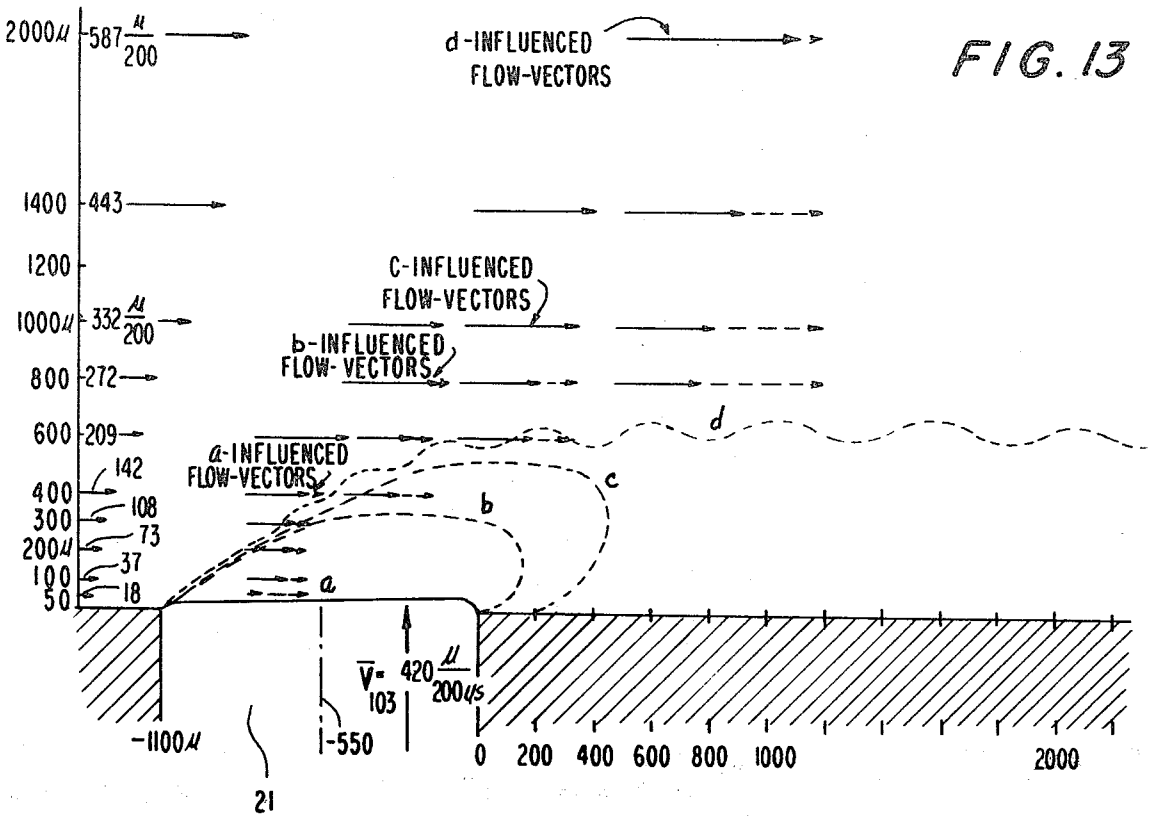
FIG. 13 is an enlarged axial cross-section of portion of throat-wall around and downstream from one water-injection hole with bar-graphs of laminar oil velocities, and sequence of possible water-oil boundaries useful in explaining a possible mode of action of my emulsifier, and a different sequence of possible water-oil boundaries.

Another sequence of droplet forms, also tremendously enlarged, which I feel is more likely to correspond to the actual action taking place in my emulsifier, is reproduced in FIG. 13. This is an axially-sectioned view of a fragment of the throat's wall, around and downstream from one injection hole 21. The center line of the injection hole is shown, but the center line of the throat, through which the sectioning plane passes, is at a δ level of 4763μ (ie is 4763μ away from the inner surface of the throat) and 30 is far above the top of this figure. At the left side is an "arrow-graph") of the well known parabolic profile of velocities. This is a kind of bar-graph (but with the bars replaced by arrows to represent the velocity-vectors of the various laminas) plotted to exactly the same tremendously enlarged scale as all the other measured distances or velocities on this figure (eg the δ-levels of the various laminas, shown on a scale at the left side of the arrow graph; or the upstream and down-stream distances in microns from the downstream edge of the hole, as shown by the scale in microns below the cross-hatched area, and by corresponding ticmarks along the inner surface of the throat's wall). The velocity vectors of the various laminas graphically show the distance traveled in 200 μsec by each lamina, the tips of the successive arrows outlining the only-slightly-curved lower 21% of the well-known parabolic velocity profile.

The first boundary a is noticeably distorted from the normal meniscus shape; this should be some what surprising since the arrow representing the velocity of the lamina at the 50 μδ level is correctly indicated as having a velocity of only 18 microns per 200 microseconds. One can mentally convert this to 9 cm/s, but in the tremendously-enlarged slow motion world of this plot, that doesn't immediately convey any clear impression of being very slow compared to the other motions nearby. But if one merely glances at this arrow—so short it is practically nothing but a very tiny arrowhead—and then glances at the arrow in hole 21 which represents (to the same scale) the mean inflowing velocity of the injected water, one immediately realizes that the amount of skew shown for meniscus a is completely out of proportion to the length ratio of these two arrows.

The reason why the meniscus is noticeably skewed is shown by the next set of six vector-velocity arrows (positioned with the tip of the top most arrow in line with the water hole's center-line. Note that the last five arrows of this set each have two heads, one showing the normal unaltered velocity of the corresponding lamina per the arrow-graph at the left side of this figure, and the other showing the locally-increased velocity (in the same lamina) in a small region aligned with such center line. The top-most arrow has only one head (showing that it is not perceptibly changed by the influence of the meniscus a) and the legend "a-influenced flow vectors" is so referenced as to indicate that it applies only to the lower five arrows. It will be seen that at the 50μδ-level the locally-increased velocity in line with the water-hole's center line is six or seven times as large as the normal velocity for this δ-level (at points a few hundred μ from this center line).

Boundary b is much more distorted than a—sufficiently distorted that it can't reasonably be called a meniscus. One reason is that the b-influenced flow-velocity just above the highest part of this boundary is almost twice the a-influenced flow-velocity just above meniscus a. Another reason is that b is 6 to 6½ times as "high" as a (more precisely stated it extends outward to a 6–6½ times as high δ-level, or it protrudes 6–6½ times as far into the oil stream). Also it is about 18% longer than a and probably about 10–20% wider than a. So its surface area exposed to the oil (its so-called wetted area) is about 1.7–1.8 times that of meniscus a, while its frontal projected-area (still of some importance even at the throat's very low Reynold's number of less than 400) is about 7 times that of meniscus a. Altogether (velocity×wetted area, up 3.1x) and (velocity$^2$×frontal area, up 22x but heavily discounted) the oil's total drag on boundary b is probably greater by a factor of 6–8 than the drag on meniscus a. But it is assumed to be still well below the rupture-point.

Boundary c is assumed to be nearing the rupture strength of the surface tension. Its top extends to about the 475 or 485μ δ-level. The c-influenced flow velocity at the 600μ δ-level is about 380 μ/200 μsec and is slightly greater at the slightly lower δ-level of c's top surface (say 385μ to 390μ per 200 μsec). Its top is definitely flattened, probably it should have been drawn with a weak but noticeable traveling wave along its upper surface (like the one shown on boundary d but only half the amplitude). This however would clutter the drawing so that the a-influenced and b-influenced vectors could not be clearly seen.

To estimate the volume which this c boundary might contain it is necessary to have some estimate of its width measured perpendicular to the down-stream direction and parallel to the very gently curving inner surface of the throat. FIG. 4*b* shows this width clearly. (Technically FIG. 4*b* is "a development" (or a developed view) of the portion of FIG. 4*a* between arrows B—B). It shows that the widest part of boundary c is 1.34 times the width of hole 21. This widest part is very slightly upstream from the most downstream part of this hole (ie is at about $+30\mu$ to $40\mu$ on the lower scale of FIG. 13. From these two views together (FIG. 13 and FIG. 4*b*) one can roughly estimate the volume contained in boundary a. It was estimated as something like the volume of a $950\mu\times450\mu\times1430\mu$ ellipsoid plus a cone with a semi-circular base. ($350\mu\times200\mu$) and an altitude of $680\mu$. This would amount to $(950\times450\times1430)\pi/6+\frac{1}{4}\pi(700^2)\times(680/6)=363\times10^6\mu^3\pm30\%$ This$=0.363$ mm$^3\pm30\%$. Then time to fill boundary c, from known water flow through one hole 21 (ie from $Q_{103}/8=1969$ mm$^3$/s would be, 363/1969. This equals 0.000,182 sec$\pm30\%$. This time of very roughly 180 $\mu$sec (to fill from a to c) indicates the appropriateness of basing all the velocities on $\mu$ per 200 us rather than $\mu$ per ms. Also if the velocities were plotted in $\mu$/ms, many of the arrows would be so long as to hopelessly clutter the figure (unless the policy of using the same length units for the actual lengths and for the velocity arrows were abandoned).

Boundary d whose description should preferably be read with both FIG. 4*b* and FIG. 13 simultaneously in view, represents a condition which I now believe probably occurred, at least part of the time, in the remarkably successful Adelphi test of August 1979. The boundary c is first assumed to have grown slightly higher, and its incipient traveling waves (probably previously present along the flat top of c but omitted for clarity) are assumed to have become more intense and have changed by reason of such greater amplitide to a strongly-distorted wave shape which throws off about 1200–6000 small to medium-small droplets (say 20–60$\mu$ equivalent diameter per millisecond, especially from the nose (just beginning to be visible in c as drawn) but becoming increasingly sharp as the whole boundary c undergoes increasing shear-deformation tending to transform it into a parallelogram form.

The 1200–6000 small to medium-small droplets/ms release only about 1–5% of the in-flowing water, so boundary c continues to grow. But it grows mostly in the down stream direction now, because the "side-pressure" from the viscous flowing oil (earlier mentioned in connection with a sketch of one possible mode of operation not deemed probable enough to be included in the drawing) is now pressing the growing drop c-d very strongly against the wall. Also the oil's down-stream drag has now exceeded the surface tension's force (for the moderately slender tail portion connecting c-d to the hole) so the drop c-d moves down stream at somewhat less than half the speed of the oil over its top surface, with a down-rolling motion in its nose and a strong clock-wise circulation in most of its interior. The tail portion does not rupture because the oil velocities against this portion are so low, and the traveling waves are so low in amplitude and smoothly sinusoidul in the region where they begin. But the boundary, which now resembles-d (but with a strongly forward-leaning front, and sharply curved nose) continues rolling forward at a sluggisly rising velocity, because the d-influenced flow-vectors (now becoming applicable) are only about 60% greater than the c-influenced vectors were some 350–650 $\mu$sec earlier). The top view of d (more precisely, the developed view) is still a closed shape (like that shown for c in FIG. 4*a*) but has stretched to $200\mu$ beyond the $+2100\mu$ tic in FIG. 13 (ie to the tic 60 in FIG. 4*b*). The d-influenced flow vectors have reached the point where they hardly increase at all with increases in the down stream length of the elongated puddle d unless accompanied by a substantial increase in its width.

A quantitative theory of puddle-influenced increases in flow-velocity has not, so far as applicant knows, been worked out. But qualitatively the $\delta$-level to which the influence extends, depends on both the length and width of the puddle, and if one is much greater than the other the smaller dimension becomes the controlling factor in determining such height. Below the $\delta$-level at which the puddle's influence starts, the vectors increase, (at first becoming only slightly greater than their normal uninfluenced value). But as one looks at lower $\delta$-levels the value of velocity reached (not the amount of the increase above normal) becomes almost constant.

The reasons why the $18\mu$ per 200 $\mu$s flow-vector was so greatly altered (percentage wise) by the $1100\mu$-diameter puddle of meniscus a were first that puddle was round, and for a round puddle the influence is estimated to extend up something like 0.3–4 diameters. Second the initial value of the flow-vector at the $50\mu$ level was very low, being almost at the zero-velocity tip of the parabolic profile. Thus an influence extending to the $400\mu$ $\delta$-level (0.36 diameter up) was altering the value of a much-larger flow-vector ($142\mu/200$ $\mu$s) and even a 5% increase in this would increase such 142 to over 149. Third the next vector ($100\mu$ below the top one influenced) is appreciably lower (say 146) but below that, other vectors remain almost constant. So at the $50\mu$ $\delta$-level a flow of 18 became 145 ($\mu/200$ $\mu$s), an increase of 3-fold.

But boundary c-d may have lengthened down to tic 60 of FIG. 4*b* without having grown appreciably wider than boundary c. It is true that FIG. 4*b* depicts the two sides of boundary d as diverging strongly, but that may or may not be true. No compelling cause for such divergence is known to applicant except that the outward, side-pressure of the moderably-fast flowing oil which presses the blob of water against the wall could cause it to widen more than it otherwise would. On the other hand oil which has been flowing in the valley (between boundary c of the central hole, here designated as 21*b* for specific identification, and the corresponding boundary c (not shown) of hole 21*c*) may become crowded and have to speed up and/or detour over these interfering boundaries. At low Reynolds number such speed-up and detouring instead of lowering the oil's side-pressure (toward the wall) and edge-pressure (toward the two blobs crowding it) may well increase these. To minimize its own shearing motions, the oil should push against these blobs to keep them apart, and this should be manifested as a force repelling whatever protrusions and in the way of its least work shear path.

Assume, for the moment, that the oil acts as just described (to press hard against any protrusions that narrow or bend its flow path). Then the relatively viscosity-free water (the 0.52 poises of 60° oil are 110 times as stiff as the 60° C. water's 0.00969 poises) may be crowded-in to a small divergent angle. If so the d-influence flow-vectors practically cease to increase, conditions are stable, and 8 fairly narrow streams flow toward the diverging cone with moderate amplitude and only moderately distorted traveling waves. The water is thrown-off in small to medium-small droplets as it was from boundary c; and afterwards is further sheared by the high shear rate in the oil where it comes to rest. The emulsion is a very good, finely divided, reasonably uniform one, perhaps with more than 95% of its droplets in the range from 2μ to 5μ diameter.

Figure 4:
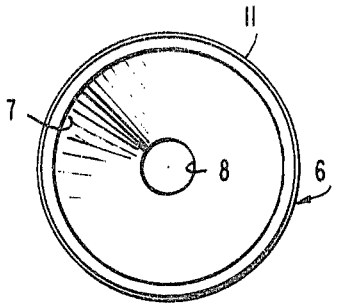
FIG. 4 is an end view of the central insert of FIG. 3.
Figure 5:
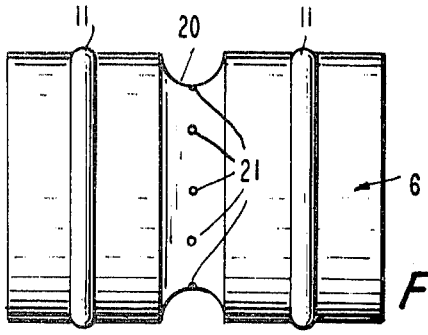
FIG. 5 is a side view of the central insert of FIG. 3.

Alternatively assume that the oil's side-pressure squeezing the weak water against the wall wins the struggle, and the developing streams from holes 21*b* and 21*c* widen enough to touch each other. Once they touch they pull together to form a single wide puddle instead of two separated narrow ones. This appreciably increases the height to which the puddle-influence extends and hence the speed of the vectors just above the boundary d. This, in turn increases the side-pressure squeezing the puddle against the wall. This kind of positive feed-back with each change altering conditions to reinforce the change can probably spread from the pair of d patterns flowing out of holes 21*b* and 21*c* to a neighboring pair, (say holes 21*b* and 21*a*). If the unit was perfect, with all holes exactly equally spread, they should all trigger together, but in fact one pair of holes may merge their d flow patterns first. But then the increase of outward squeezing of these two patterns may make them merge with their opposite neighbors, since these should be almost ready to merge anyway. Once the patterns of all eight holes have merged, the puddle is effectively of infinite width since it covers the whole inside circumference of throat 8. Now the upstream-downstream length is the only limiting factor to prevent the whole throat from transitioning from a parabolic velocity profile (with the outer layers shearing strongly but with zero velocity) to a "solid lubricated slug" profile (when all the oil travels almost like a solid drum-shaped slug, all at practically the same velocity and where nearly all the shear burden is placed on the 600μ thickn layer of water adjacent the wall. This cannot happen unless the downstream length of the throat is long compared to its diameter. And FIG. 4*b* shows that in the preferred impediment of FIGS. 1–9, the downstream length is only 4.06 mm, less than half the diameter.

It is not clear whether or not the deep cusp-shaped oil-wetted areas between the d boundaries of a fully-merged set of 8 holes will actually shrink due to water drawn into them by a "viscous-suction" force. Such a force (perhaps not yet identified and named) must exist, and is probably strong, in view of the substantial reduction in viscous work done (per μs) on the oil, if the region of water lubrication between the oil and the wall grows in area. Such viscous suction must be stronger if the growth is in a favorable direction (e.g. upstream-downstream when that is the smaller puddle dimension.

Certainly there are opposing forces tending to prevent such upstream growth. The wall-hugging oil streamlets hitting the water barriers across the previously open valleys will tend to keep these barriers from pulling upstream. It probably depends on the original angles of divergence defined by lines line 61*c* and 62 which are tangent to the edges of holes 21*b* and 21*c*, and which cross at the original instaneous meeting point of the d boundaries of these holes. If the original contact point was as depicted in FIG. 4*b*, the cusp-like tips of the inter-boundary spaces will amost certainly round somewhat, and may pull a little farther upstream; but if the divergence angles of tangent lines 61 and 62 were much greater than 50° to 65° they probably would not pull upstream, because the oil flowing down the valleys and detouring up over these barriers has some impact pressure (even at Re<400) plus some viscous detour-resisting edge-pressure (greater at low Re numbers).

It seems likely that the preferred embodiment may sometimes act in the first and at other times act in the second of the two different modes of operation above described: (1) operation with 8 fully separate streams probably never touching each other) these streams being necessarily much narrower than shown by boundaries d of FIG. 4*b*; and (2) operation with 8 fully merged streams, with one single boundary. This operational single boundary might faintly resemble the shape shown in FIG. 4*b* (which is supposed to depict the shape at the moment of first meeting of the boundaries d of holes 21*b* and 21*c*), but would almost certainly have the sharp cusp s rounded and probably would resemble a set of 8 catenary curves, between the 8 holes, and tangent thereto, probably with the divergence angles (which in the figure are 30° each) being more like 45–65 degrees.

The mode of operation adopted by the preferred embodiment of my emulsifer may depend only on the flow rates, working viscosities, and the other conditions existing at the time of operation. But it seems probable that if all eight streams once merge, they may stay merged even when conditions are suitable to support the separate-stream mode. Probably if started with a water/oil ratio of zero which is gently raised to 0.07, or 0.08, it would operate indefinitely in the 8-stream mode. But if this ratio were increased to 0.15 and then gently lowered to 0.08 or 0.07, it would very likely operate indefinitely in the fully-merged mode. It is believed the fully-merged mode gives a finer, more-uniform emulsion.

The modified-embodiment of FIGS. 12*a*, 12*b* is almost self-explanatory. The two major differences between this and the preferred embodiment are that the modified one has 18 holes (instead of 8 and has a downstream length of at least 7.6 mm (instead of about 4.06 mm). It is hoped and expected that it will work in the modes postulated for the preferred model, except that it should enter and remain in the fully merged mode at much lower water/oil ratios (if indeed any of the postulated modes exist or can exist at all for either this modified model or the preferred one). Even if the operation doesn't take place as postulated, but in a somewhat different or wholly different way, applicant believes the modification of FIGS. 12*a* and 12*b* may be advantageous in that the mean water flow velocities $V_{103}$ or $V_{73}$ or $V_{102}$ and $V_{72}$ will be far below the mean oil flow velocity $V_{02}$ or $V_{03}$ respectively without in any way impairing the oil's very low Reynolds number (both of which characteristics are thought by applicant to be important even if his hypotheses about modes of operation are wrong).

FIG. 14 shows an axially sectioned fragment of throat 8 at another variant of my preferred embodiment. If FIGS. 1–9 and 13 actually operate sometimes with eight separate streams and at other times with all eight fully merged into one circumference-spanning stream, the modifications of FIGS. 12*a* and 12*b* and the modifications of FIG. 14 are both intended to insure operation with a fully merged oil-surrounding stream at lower flow rates than those needed to attain and maintain such stream with the preferred, carefully tested embodiment. Both these variants are expected to give fully oil-surrounding streams with water/oil ratios down to 0.07 or 0.06 or lower.

Also both are expected to accept water/oil ratios far above 0.10 while still keeping the "normal injection velocity" (i.e. the radial component—perpendicular to the oil flow) of the mean velocity, $V_w$, of the water injected into the throat) less than or comparable with the mean velocity $V_0$ of the oil flow along the throat.

As shown in FIG. 14 the water-injection holes 21 (of which there are preferably 8 to 20) do not inject their water into the oil stream directly, but via a small annular re-distribution groove 67 which then injects the evenly-distributed water through an inclined slit 68, whose slit width (i.e. whose upstream/downstream dimension along the throats inner wall) is 0.10922 cm (equal to the diameter d of any of the holes 21). Thus its actual water injection area $=\pi D\times d=0.327$ cm$^2$ instead of being $2\pi d^2=0.075$ cm$^2$ for 8 holes as in FIGS. 1–9, or being $4.5\pi d^2$ for 18 holes as in FIGS. 12*a*, 12*b*. So the water injection area/throat area ratio of this variant is $\pi Dd/(D^2\times\pi/4)=4d/D=0.459$. Thus its normal injection velocity will remain less than or comparable with the mean oil flow velocity in the throat even for water-/oil ratios as high as 0.50 or slightly higher.

For ease of manufacture, insert 6 is made in two parts 6*a*,6*b* which fit together along their common cylindrical interface. Preferably this fit is a press fit so parts will not separate during handling. Groove 67 is now rectangular for ease of manufacture. The downstream length of the throat 8 is preferably $\geqq 1$ cm.

It is apparent from the foregoing discussion that applicant's understand of the mode of operation of his preferred embodiment is very incomplete, doubtful and likely erreneous (and his understanding of the modified embodiments is even less complete and more subject to error), and therefore it must be understood that he is in no way bound by his above-presented hypotheses, conjectures, and opinions (nor restricted to claims in conformity therewith) but is limited only as defined in the appended claims.

I claim:

1. In an improved oil-burning heat-producing system which has a rated maximum firing rate and which includes a firebox, means supplying fuel-oil under pressure, means supplying admix water under pressure, an emulsifier for emulsifying said water into said oil in the form of small droplets, an atomizing burner adapted to atomize said water-in-oil emulsion into tiny globules in air and to project said atomized emulsion into said firebox, whereby water globules which contain one or more droplets become still more finely atomized by the rapid vaporization of said droplets, the improvement wherein said emulsifier has:

an approximately cylindrical oil-flow constraining throat D centimeters in diameter carrying the flowing fuel oil in a given flow direction therethrough, said throat being located between smoothly converging and smoothly diverging generally conical flow surfaces which are substantially symmetrical relative to said throat;

means in communication with said smoothly converging flow surface for imparting swirling movement to the oil flow in a direction at an angle to said given flow direction before said flowing fuel oil reaches said throat; and a multiplicity n of water-injection holes in said throat, each water-injection hole having a smaller diameter of d centimeters than said throat diameter, each of said water injection holes extending approximately radially to said throat;

the combined areas ($0.25\pi d^2$) of said n water-injection holes being 0.075 to 0.30 times the total area ($0.25\pi D^2$) of said oil-flow throat.

2. The system of claim 1, wherein:

the water-supply means and oil-supply means are adjusted so that at maximum firing rate of the system the combined water-flow $Q_w$ (in cm$^3$/sec) through all said n holes is 0.07 to 0.10 times the total oil flow $Q_w$ (in cm$^3$/sec) through said oil-flow throat; and the combined area ($0.25n\pi d^2$) of said n water-injection holes is 0.10 to 0.24 times the total area ($0.25\pi D^2$) of said throat.

3. In an improved oil-burning heat-producing system which has a rated maximum firing rate and which includes a firebox, means supplying fuel-oil under pressure, means supplying admix water under pressure, an emulsifier for emulsifying said water into said oil in the form of small droplets, an atomizing burner adapted to atomize said water-in-oil emulsion into tiny globules in air and to project such atomized emulsion into said firebox, whereby water globules which contain one or more droplets become still more finely atomized by the rapid vaporization of said droplets, the improvement wherein:

said emulsifier has an approximately cylindrical oil-flow throat of diameter D centimeters, carrying said oil in a given flow direction therethrough, and a multiplicity n of water-injection holes in said throat, each of smaller diameter d centimeters, extending approximately radially to said throat, said throat being located between smoothly converging and smoothly diverging generally conical flow surfaces which are substantially symmetrical relative to said throat;

means in communication with said smoothly converging flow surface for imparting swirling movement to the oil flow in a direction at an angle to said given flow direction before said flowing fuel oil reaches said throat; and said throat is dimensioned and has a surface configuration such that even at maximum firing rate the oil-flow rate $Q_o$ (in cm$^3$/sec) through the throat is so reated to D (in cm) and to the oil's kinematic viscosity (in stokes) that the oil-flow Reynold's number $Re_0$ is substantially less than 1200.

4. The system of claim 3, wherein said smoothly converging flow surface of said emulsifier includes a larger diameter oil-flow-carrying portion of at least twice the diameter of the throat just ahead of said throat, and said swirl-imparting means being located in said larger diameter portion and being adapted to impart a substantially smooth swirl component to the oil flow, said larger diameter portion being coupled to said throat through said convergent portion which further smooths the swirl and increases the rotation rate of the imparted swirl while also increasing the downstream translational velocity of the flow, whereby a centrifuge action is established tending to make the water droplets drift outward (or at least reducing their inward drift) so that these droplets remain longer in the lower velocity higher shear rate regions within 0.25D from the throat's inner surface.

5. The system of claim 3, wherein the mean oil velocity in the throat $V_0$ (cm/sec), which equals $(Q_0)/(0.25\pi D^2)$, is greater than or comparable to the mean velocity of the injected water $V_w$ (cm/sec), which equals $(Q_w)/(0.25n\pi d^2)$, where $Q_w$ is the water flow rate.

6. The system of claim 3, wherein $(Q_0)/(0.25n\ D^2)$ is 1.05 to 1.65 times $(Q_w)/(0.25n\ d^2)$.

7. The system of claim 3 or 4 further comprising a baffle element at the outlet of said emulsifier.

8. In an improved mixer for a passive emulsifier of the type which produces a two-liquid emulsion in the form of a first percentage mP of a first liquid dispersed in a second percentage dP of a second liquid by injecting said first liquid into a flow channel through which said second liquid is flowing, the improvement wherein:

said mixer has a substantially-straight flow channel of generally round cross-section shape, said flow channel being substantially straight over a given length which is greater than about half the diameter of said round cross-sectional shape and said flow channel having a substantially constant cross-sectional area B over said length thereof, through which said second liquid flows;

said mixer includes means adjacent said substantially-straight flow channel for imparting angular swirling movement to said second liquid prior to said second liquid reaching said substantially-straight flow channel, said angular movement being in a direction at an angle to the direction of flow through said substantially-straight flow channel;

said flow channel being located between converging and diverging surfaces of said mixer;

balanced injection-means is provided in said mixer, including one or more injection-openings through an inner wall surface thereof for injecting said first liquid into said substantially straight flow channel in at least six centripetal directions, to provide a substantially balanced inflow, the total injection area A of said balanced-injection-means, measured at the interior surface of said flow channel and parallel to such surface, being smaller than B;

the ratio A/B of said channel areas in said mixer is larger than the ratio mF/dF of the desired emulsion, whereby the mean flow velocity of said second liquid in said flow channel is larger than the centripetal components of the injected velocities;

and said mixer being connected to a combustion device on the downstream side thereof.

9. An improved mixer orifice according to claim 8, wherein said injection means includes at least 6 separate injection holes (21) injecting said first liquid in at least 6 centripetal directions.

10. An improved mixer according to claim 8, wherein said injection means includes at least 8 separate injection holes (21) injecting said first liquid in at least 8 centripetal directions.

11. An improved mixer according to either of claims 8 or 9, wherein said injection holes are normal to the center line of said flow channel through which said second liquid is flowing.

12. An improved mixer according to claim 8, wherein said injection means includes a conically-sloping annular opening (68) spanning the whole inner circumference of said flow channel (8) for injecting said first liquid in more than 6 centripetal directions, all aiming inwardly toward the centerline of said flow channel (8) as well as being inclined conically downstream.

13. An improved mixer according to claim 12, wherein said annular opening (68) comprises a slit spanning said whole inner circumference of said flow channel (8) for injecting said first liquid in an infinite continuum of directions, all aiming inwardly toward the center line of said flow channel (8) as well as being inclined conically downstream.

14. In an improved heat-producing system intended to be used at varying firing rates, and including a firebox; an atomizing oil burner for atomizing fuel oil by means of a gaseous atomizing medium and igniting it and projecting it into said firebox; means for supplying fuel oil, atomizing medium, primary combustion air, secondary combustion air, and admix water; a ganged-modulating-control arrangement for varying several flow rates together to conveniently and efficiently modulate the firing-rate (including appropriately varying at least the flow of fuel oil, primary and secondary air, and admix water) over a range of flows from a high flow rate (corresponding to the highest firing rate used) down to some substantially lower flow rate; and an emulsifier for admixing said water into said oil in the form of tiny droplets to thereby improve combustion, the improvement wherein said emulsifier comprises:

a substantially round cylindrical throat, D cm in diameter, and $\pi D^2$ in cross-sectional area carrying said oil, said throat being substantially straight over a given length in the oil flow direction which is greater than about half the diameter (D) of said round throat, said throat haviing a substantially constant cross-sectional area B over said length thereof;

means adjacent said throat for imparting swirling angular movement to said oil flow prior to said oil flow reaching said throat, said angular movement being in a direction at an angle to the oil flow direction through said throat;

said emulsifier including a converging portion between said swirl imparting means and said throat; and balanced water-injection means, for injecting said water into said throat in six or more evenly distributed centripetal directions so as to provide a substantially balanced inward flow, said injection means including one or more injection openings through the inner surface of said throat.

15. An improved system according to claim 14, wherein the mean radial component of the velocity of the water entering the throat is less than three fourths the mean velocity of the oil flow through the throat.

16. An improved system according to claim 14, wherein said balanced injection means includes one single slit spanning the whole inner circumference of said throat and several separate water feed channels supplying water for injection through said slit.

17. Improved method of making a uniformly fine water-in-oil emulsion for use as a clean-burning and efficiently-burning fuel in an oil-burning system, by establishing and maintaining a substantially cylindrical oil flow, constrained by a substantially cylindrical internal constraining surface of diameter D in an emulsifier body, and simultaneously injecting a multiplicity of water streams of a smaller diameter d approximately radially into said oil flow; the improvement wherein:

said internal constraining surface is oil-wettable; converging the flow of oil into said constraining cylindrical surface; and providing a swirl-imparting means upstream of said constraining substantially cylindrical internal surface of diameter D for imparting a swirl to the oil flow prior to said injection of water.

18. The method of claim 17 wherein said swirl-imparting means establishes said substantially cylindrical oil flow so as to produce a smoothly swirling oil flow including not only the usual linear downstream motion but also a swirl component of motion producing a centrifuge action which causes denser water droplets from said injected water streams to drift outward or at least slow their inward drift whereby said denser water droplets remain longer in lower velocity higher shear rate regions in said emulsifier body about 0.25D from said constraining surface.

19. The improved system according to claim 14, wherein the total injection area A of said balanced injection means, as measured at the interior surface of said throat and parallel to said throat, is dimensioned such that the water/oil ratio, the mean radial component, perpendicular to the center line of said throat, of the velocity of said water entering the throat is less than or comparable with the mean velocity of the oil flow through said throat.

* * * * *